US009745765B2

(12) United States Patent
Saccoccio et al.

(10) Patent No.: US 9,745,765 B2
(45) Date of Patent: Aug. 29, 2017

(54) SWIMMING POOL FLOATING COVER

(71) Applicant: Asia Connection LLC, New York, NY (US)

(72) Inventors: Mitch Saccoccio, Clarksville, VA (US); Jonathan Bonelli, New York, NY (US)

(73) Assignee: ASIA CONNECTION LLC, New York, NY (US)

( * ) Notice: Subject to any disclaimer, the term of this patent is extended or adjusted under 35 U.S.C. 154(b) by 230 days.

(21) Appl. No.: 13/912,798

(22) Filed: Jun. 7, 2013

(65) Prior Publication Data

US 2013/0333107 A1 Dec. 19, 2013

Related U.S. Application Data

(60) Provisional application No. 61/660,074, filed on Jun. 15, 2012.

(51) Int. Cl.
*E04H 4/10* (2006.01)

(52) U.S. Cl.
CPC ..... *E04H 4/106* (2013.01)

(58) Field of Classification Search
CPC E04H 4/10; E04H 4/103; E04H 4/105; E04H 4/106; E04H 4/108
USPC ..... 4/498
See application file for complete search history.

(56) References Cited

U.S. PATENT DOCUMENTS

| | | | | |
|---|---|---|---|---|
| 4,685,254 | A | 8/1987 | Terreri | |
| 4,825,479 | A | 5/1989 | Bonneau | |
| 4,953,239 | A | 9/1990 | Gadsby | |
| 5,144,704 | A | 9/1992 | Genzel et al. | |
| 6,954,948 | B1 * | 10/2005 | Asack | E04H 4/10 4/498 |
| 7,874,023 | B1 * | 1/2011 | Sundling | E04H 4/105 4/498 |
| 2003/0079279 | A1 * | 5/2003 | Bonelli et al. | 4/498 |
| 2009/0151065 | A1 * | 6/2009 | Watson | E04H 4/106 4/503 |

* cited by examiner

*Primary Examiner* — Janie Loeppke
(74) *Attorney, Agent, or Firm* — Dilworth & Barrese, LLP.

(57) ABSTRACT

A pool cover includes a flexible, water impervious sheet of material having a centrally located float disposed on an upper surface of the material. In an embodiment the float member comprises a closed cell polymeric foam member. In an embodiment the polymeric foam float member is disposed within a pocket formed by a cover sheet attached to the water impervious sheet of the pool cover.

12 Claims, 4 Drawing Sheets

SWIMMING POOL FLOATING COVER

CROSS-REFERENCE TO RELATED APPLICATIONS

The present application claims priority to U.S. provisional application No. 61/660,074 filed Jun. 15, 2012, which is herein incorporated by reference.

BACKGROUND

1. Field of the Invention

The present invention relates to a swimming pool cover and, more particularly, to a floating swimming pool cover.

2. Background of the Art

During winter months owners of above ground swimming pools may be required to cover their pools. The existing covers are usually anchored around the pool perimeter and supported in the pool by balloon-like floats. The floating supports tend to either deflate or move about resulting in sagging portions that collect leaves, branches and water. As a result, the pool owner must constantly adjust the cover, re-position and inflate the floats, and tighten the perimeter anchoring. Further, the cover can become damaged and torn due to the excessive stress created by the collected water and debris. Ultimately, the cover may need to be replaced prematurely and at a considerable cost. Another identified problem is that existing covers' often trap water posing a potential drowning hazard to children and pets.

Several attempts have been made in the past to cover and protect a swimming pool, especially during extended periods of inactivity. U.S. Pat. No. 4,685,254 in the name of Terreri discloses a pool cover support comprising a balloon for placement on the surface of the water in a swimming pool, an air hose with one end attached to said balloon and another attached to a valve, that when during an inflation, the balloon can raise a pool cover to prevent build-up of unwanted debris thereon the pool cover. However, the Terreri device does not provide a tie-down means to secure the pool cover via ropes or strapping to an exterior location.

U.S. Pat. No. 4,825,479 to Bonneau discloses an inflatable swimming pool cover adapted to become arched over the pool when air under pressure is projected under the cover, having a skirt adapted to hang in the water adjacent to a peripheral side wall with a series of holes that bleed air in order to maintain the cover at a desired height. In the Bonneau device a constant supply of pressurized air must be introduced to the cover, thereby increasing energy consumption and maintenance.

U.S. Pat. No. 4,953,239 to Gadsby describes an inflatable swimming pool cover which, when installed and inflated with a blower, floats on a water surface and has a bulbous surface raising above the swimming pool perimeter. The Gadsby device also depends on a constant supply of pressurized air must be introduced to the cover, thereby creating the same energy consumption and maintenance problems as in the Bonneau device.

U.S. Pat. No. 5,144,704 to Genzel et al. discloses a swimming pool cover with multiple air compartments which are fixed in location with respect to each other, which may be interleaved with laterally overlapping portions. The cover also comprises a removable exterior portion which is exposed for cleaning and maintenance.

However, inflatable swimming pool covers are subject to undesirable deflation, for example, from puncturing of the pool cover or floats. A need still exists for a simple, swimming pool cover for winter use that retains its buoyancy even if the cover is punctured or torn.

SUMMARY

A pool cover is provided herein which comprises a flexible, water impervious sheet of material having a centrally located float disposed on an upper surface of the material. In an embodiment the float member comprises a closed cell polymeric foam member. In an embodiment the polymeric foam float member is disposed within a pocket formed by a cover sheet attached to the water impervious sheet of the pool cover.

The objects, features and advantages of the present invention will become apparent from the following detailed description of illustrative embodiments, which is to be read in connection with the accompanying drawings.

BRIEF DESCRIPTION OF THE DRAWINGS

Various embodiments are described below with reference to the drawings wherein.

DETAILED DESCRIPTION OF PREFERRED EMBODIMENT(S)

The present disclosure describes a simple, floating swimming pool cover while optionally still maintaining a predetermined amount of water on top of the pool cover.

Figure 1:
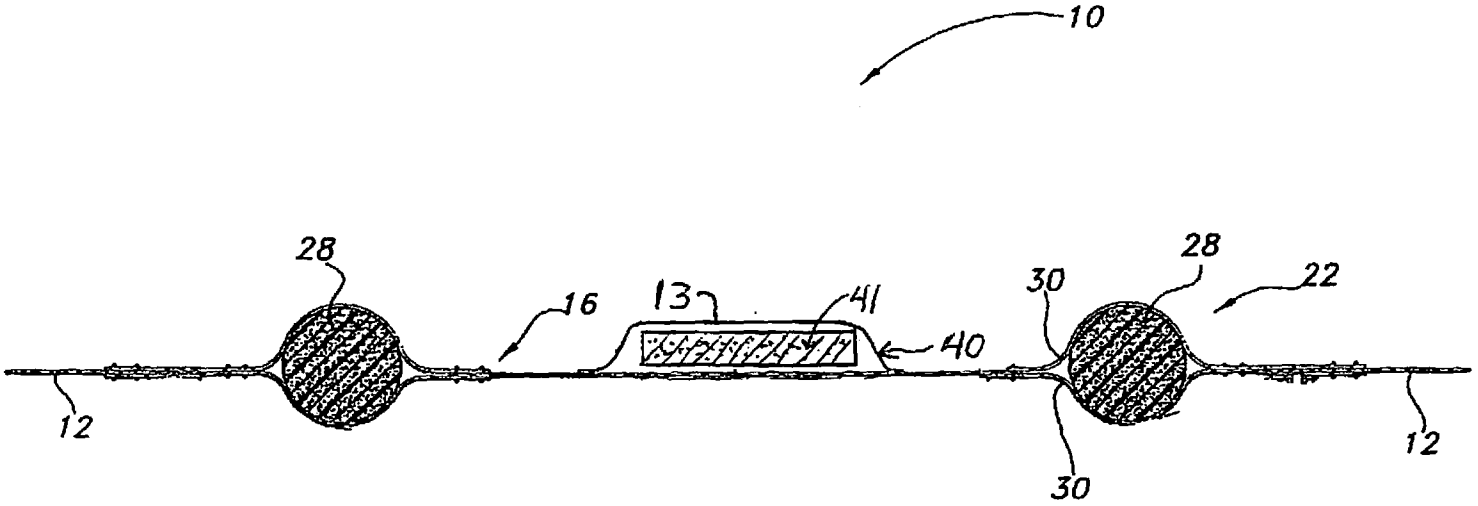
FIG. 1 is a side view illustrating a swimming pool cover in accordance with the present invention.

Referring now in specific detail to the drawings in which like reference numerals identify similar or identical elements throughout the several views, and initially to FIG. 1, one embodiment of a floating swimming pool cover constructed in accordance with the present disclosure is shown generally as floating swimming pool cover 10.

In an embodiment swimming pool cover 10 includes a pool cover 12 having a central layer 16 which includes a sewn in central float 40.

Pool cover 12 is preferably formed of a vinyl or other flexible plastic water impervious material. The peripheral edge regions (not shown) of the pool cover 12 are affixed to the perimeter of a swimming pool by weights, clamps or the like, all in a manner known to one having ordinary skill in the art.

In an embodiment, the pool cover can include a barrier assembly 22 to ensure that a volume of water remains on the cover to assist in keeping the cover in position during windy weather. Barrier assembly 22 is preferably formed by placing a buoyant material 28, such as Styrofoam® or other type of closed cell foamed polymer, within a pocket formed by two sections of cover material 30 and is attached to the cover 12 around the perimeter of the central portion of the pool cover. Buoyant material will ensure that the cover 12 floats above the water level in the pool. The pocket is preferably formed by attaching two sections of cover material together by stitching, welding or any other means known to one having ordinary skill in the art. An opening may be left in the pocket to facilitate the insertion of material 28 afterwards, or the pocket may be formed around material 28.

Figure 2:
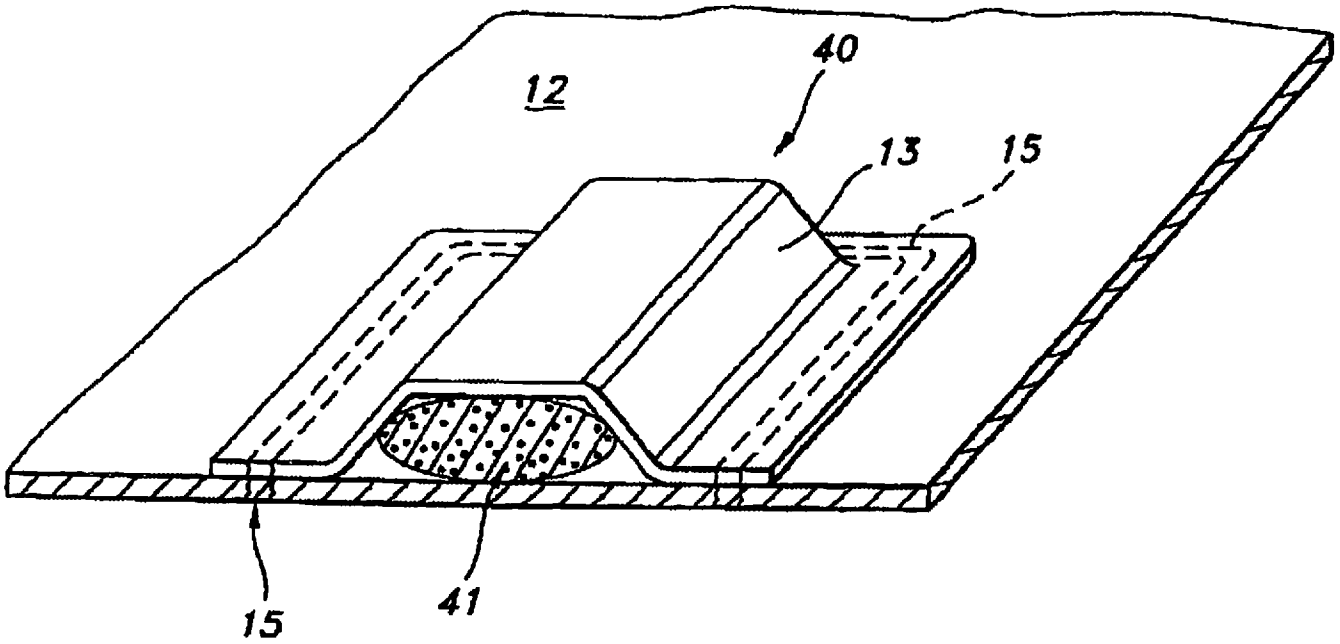
FIG. 2 is an isometric sectional view illustrating a float.

Referring to FIG. 2, the sewn-in central float 40 includes a buoyant material 41 secured to the top surface of pool cover 12 by cover material 13 which is attached to pool cover 12 by peripheral stitching 15. Buoyant material 41 can be any suitable material such as polymeric foam (e.g. Styrofoam® brand) or any material or object having a density less than water. Cover material 13 can be the same material as pool cover 12 and is preferably a polymer sheet. Stitching 15 is preferably double stitching.

Figure 3:
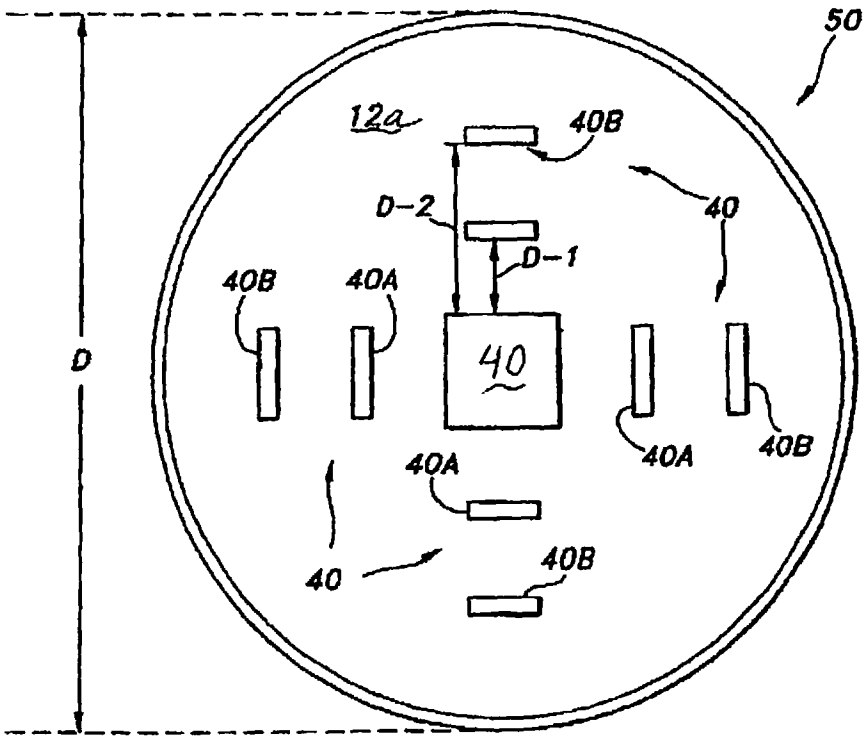
FIGS. 3 and 4 are plan views of the pool cover showing additional float arrangement.
Figure 4:
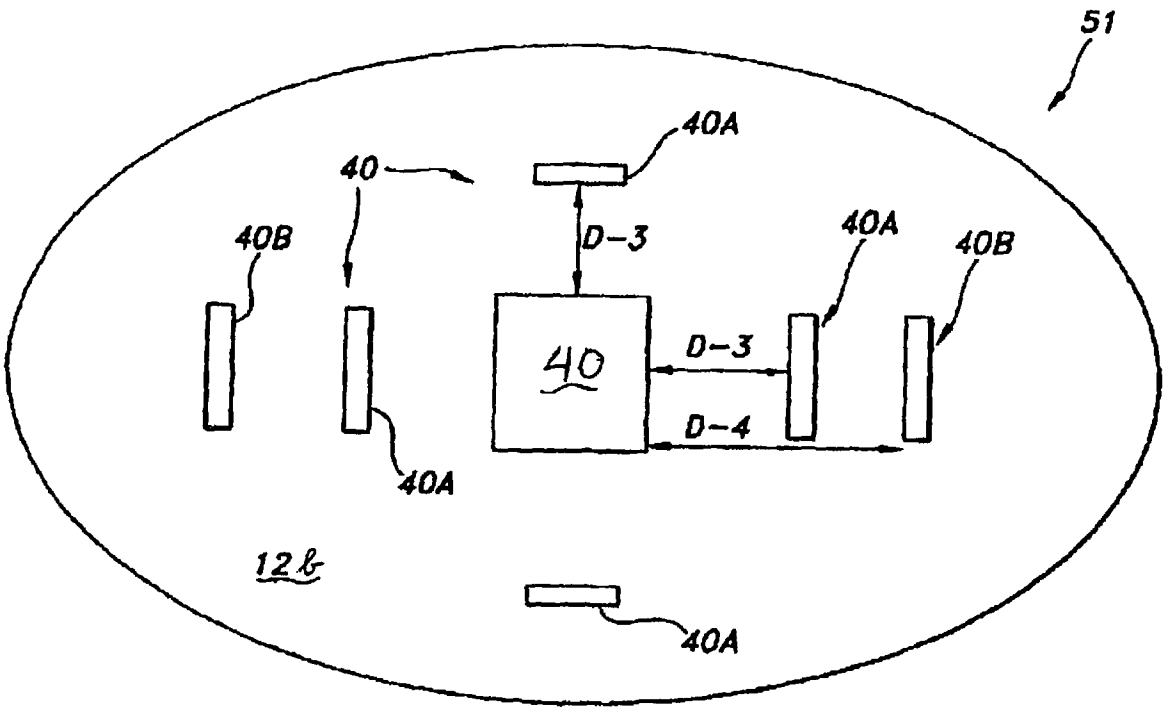

Referring now to FIGS. 3, and 4, additional floats can be incorporated into the pool cover to maintain buoyancy across the pool cover 12. Additional floats are advantageous for large size pool covers to prevent portions of the cover from sagging and accumulating pockets of water.

Referring particularly now to FIG. 3, in an embodiment a circular swimming pool cover assembly 50 is shown which includes a pool cover 12*a* and a plurality of floats. Preferably, at least four inner floats 40A are symmetrically arranged as opposite pairs such that imaginary lines between each pair together form a cross. The four inner floats 40A are each equidistant from the respective edge of the central float 40 by a distance D-1. Depending upon the size of the pool cover, a second set of outer floats 40B may optionally also be included in the swimming pool cover assembly 50. Floats 40B are positioned outward from and in alignment with corresponding inner floats 40A in a symmetrical cross-like configuration. Outer floats 40B are each equidistant from the respective edge of the central float 40 by a distance D-2.

By way of illustration, the following Table I sets forth exemplary distances for various pool cover diameters D.

TABLE 1

| Pool Cover Diameter | D-1 | D-2 |
|---|---|---|
| 8 feet | No floats 40A | No floats 40B |
| 12-15 feet | 24 inches | No floats 40B |
| 18-21 feet | 36 inches | No floats 40B |
| 24-27 feet | 36 inches | 72 inches |

Referring now to FIG. 4, oval shaped swimming pool cover assembly 51 with floats 40 is illustrated wherein inner floats 40A are spaced from the central float 40 a distance D-3 and optional outer floats 40B are spaced apart from the central float 40 a distance D-4. The outer floats 40B are generally only positioned, if needed, along the major axis of the pool cover 12*b*. Typically, for pool covers ranging in size from about 10'×16' to about 12'×18' (smaller distance is the length of the minor diameter, larger distance is the major diameter) only floats 40A are needed and D-3 is approximately 24 inches distance between inner floats 40A and the central float 40.

For pool covers ranging in size from about 12'×24' to about 16'×25', floats 40A and 40B are included wherein D-3 is about 24" and D-4 is about 48".

Although the illustrative embodiments of the present invention have been described herein with reference to the accompanying drawings, it is to be understood that the invention is not limited to those precise embodiments, and that various other changes and modifications may be affected therein by one having ordinary skill in the art without departing from the scope or spirit of the invention. For example, the pool cover can have as many floats as are necessary to accomplish the functions described above. Moreover, the floats can be positioned in diagonal or other arrangement in addition to, or instead of, along the major and minor axes of the pool cover. The pool cover can be any suitable shape such as circular, oval, quadrangular, triangular, and the like. Accordingly, the invention is not limited by the number and arrangement of the floats or the shapes of the pool cover as illustrated by the embodiments described herein. All variations and modifications are intended to be included within the scope of the invention as defined by the appended claims.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A pool cover including a flexible, water impervious sheet of material having a float member positioned at a center of the pool cover disposed on an upper surface of the material, wherein the float member is disposed within a pocket formed by a cover sheet attached to the water impervious sheet of the pool cover, wherein a peripheral edge of the cover sheet is attached to the water impervious sheet of the cover by adhesive, and in addition to the centrally located float, a plurality of float members attached to the pool cover and spaced apart from the centrally located float.

2. The pool cover of claim 1 wherein the float member comprises a closed cell polymeric foam member.

3. The pool cover of claim 1 wherein the cover sheet is water impervious.

4. The pool cover of claim 3 wherein the cover sheet is fabricated of the same material as the water impervious sheet of the cover.

5. The pool cover of claim 1 wherein the water impervious sheet of the cover is vinyl.

6. The pool cover of claim 1 wherein the plurality of float members comprises at least a first array of floats spaced apart from the centrally located float by a first distance.

7. The pool cover of claim 6 wherein the plurality of floats comprises a second array of floats spaced apart from the centrally located float by a second distance, wherein the second distance is greater than the first distance.

8. The pool cover of claim 6 wherein the first array of floats comprises four floats.

9. The pool cover of claim 7 wherein the second array of floats comprises four floats.

10. The pool cover of claim 1 further comprising a buoyant barrier assembly having a buoyant material connected to the pool cover to maintain a predetermined amount of water on the pool cover.

11. The pool cover of claim 6, wherein based on the float member positioned in the center of the pool cover and the first array of floats spaced apart from the centrally located float by the first distance, a predetermined amount of water is maintained between the float member positioned in the center of the pool cover and the first array of floats.

12. A pool cover including a flexible, water impervious sheet of material having a float member positioned at a center of the pool cover disposed on an upper surface of the material, wherein the float member is disposed within a pocket formed by a cover sheet attached to the water impervious sheet of the pool cover, wherein a peripheral edge of the cover sheet is attached to the water impervious sheet of the cover by stitching, and in addition to the centrally located float, a plurality of float members attached to the pool cover and spaced apart from the centrally located float.

* * * * *